United States Patent [19]

McCarty

[11] Patent Number: 5,025,531

[45] Date of Patent: Jun. 25, 1991

[54] GRAVITY SWING DOOR HINGE

[75] Inventor: Lon H. McCarty, Estacada, Oreg.

[73] Assignee: Econo Max Manufacturing, Gresham, Oreg.

[21] Appl. No.: 375,257

[22] Filed: Jun. 30, 1989

[51] Int. Cl.[5] ..... E05F 1/02

[52] U.S. Cl. ..... 16/313; 16/250

[58] Field of Search ..... 16/313, 315, 314, 318, 16/250, 223

[56] References Cited

U.S. PATENT DOCUMENTS

| | | | |
|---|---|---|---|
| 377,910 | 2/1888 | Pugh | 16/313 |
| 1,643,621 | 9/1927 | Fischer | 16/313 |
| 1,920,509 | 8/1933 | Jones et al. | 16/313 |
| 2,840,848 | 7/1958 | Hickey | 16/313 |
| 4,084,347 | 4/1978 | Brown . | |
| 4,406,034 | 9/1983 | Lindemann | 16/313 |

OTHER PUBLICATIONS

Installation Instructions & Parts Diagram for Easy Swing Double Action Solid Core Partition Doors; Eliason Easy Swing Door Division, Kalamazoo, Mich. 49003.

Product brochures concerning gravity swing doors including: Tec®-Door; Bar-I-Air®; Durulite®; Series 9000 and 8000; McGuire®; and Rubbair® Door.

*Primary Examiner*—Richard K. Seidel
*Assistant Examiner*—James Miner
*Attorney, Agent, or Firm*—Klarquist, Sparkman, Campbell, Leigh & Whinston

[57] ABSTRACT

A gravity swing door hinge includes flange guards for protecting the hinge from damage and a telescopic cover assembly for protecting the cam and eliminating pinch points between cam parts and between the door and the hinge body. The hinge may be flush mounted to a door jamb while providing a broad range of pivotal movement on each side of its closed position.

14 Claims, 3 Drawing Sheets

FIG. 1
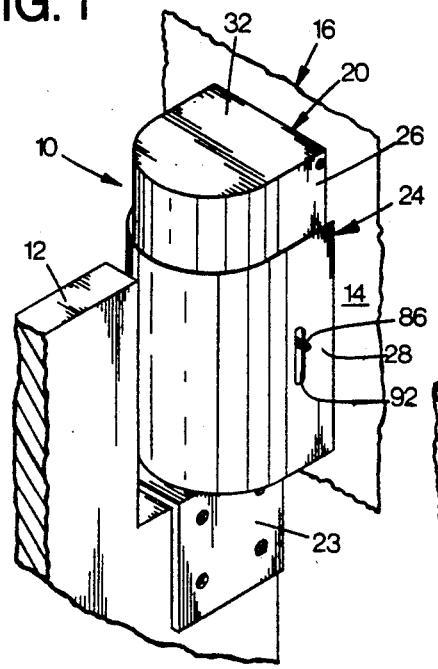
FIG. 2
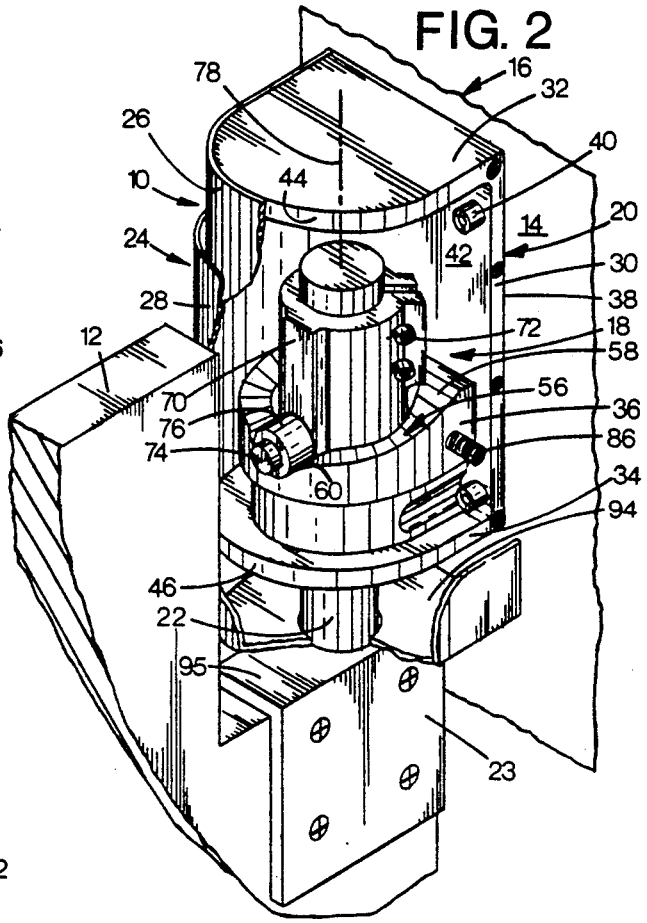
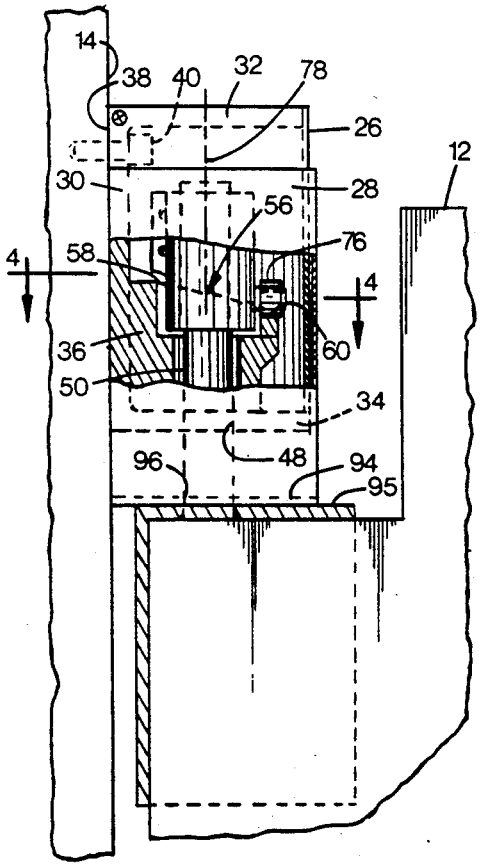
FIG. 3
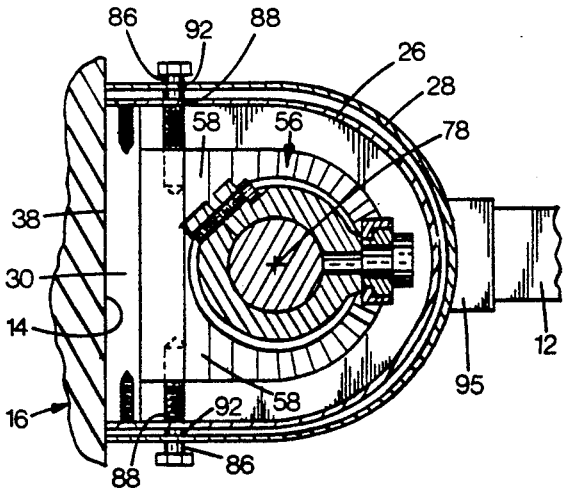
FIG. 4

FIG. 5
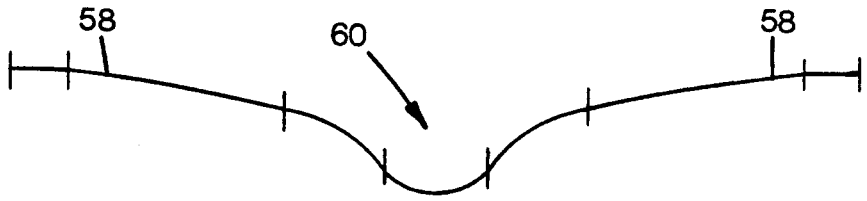
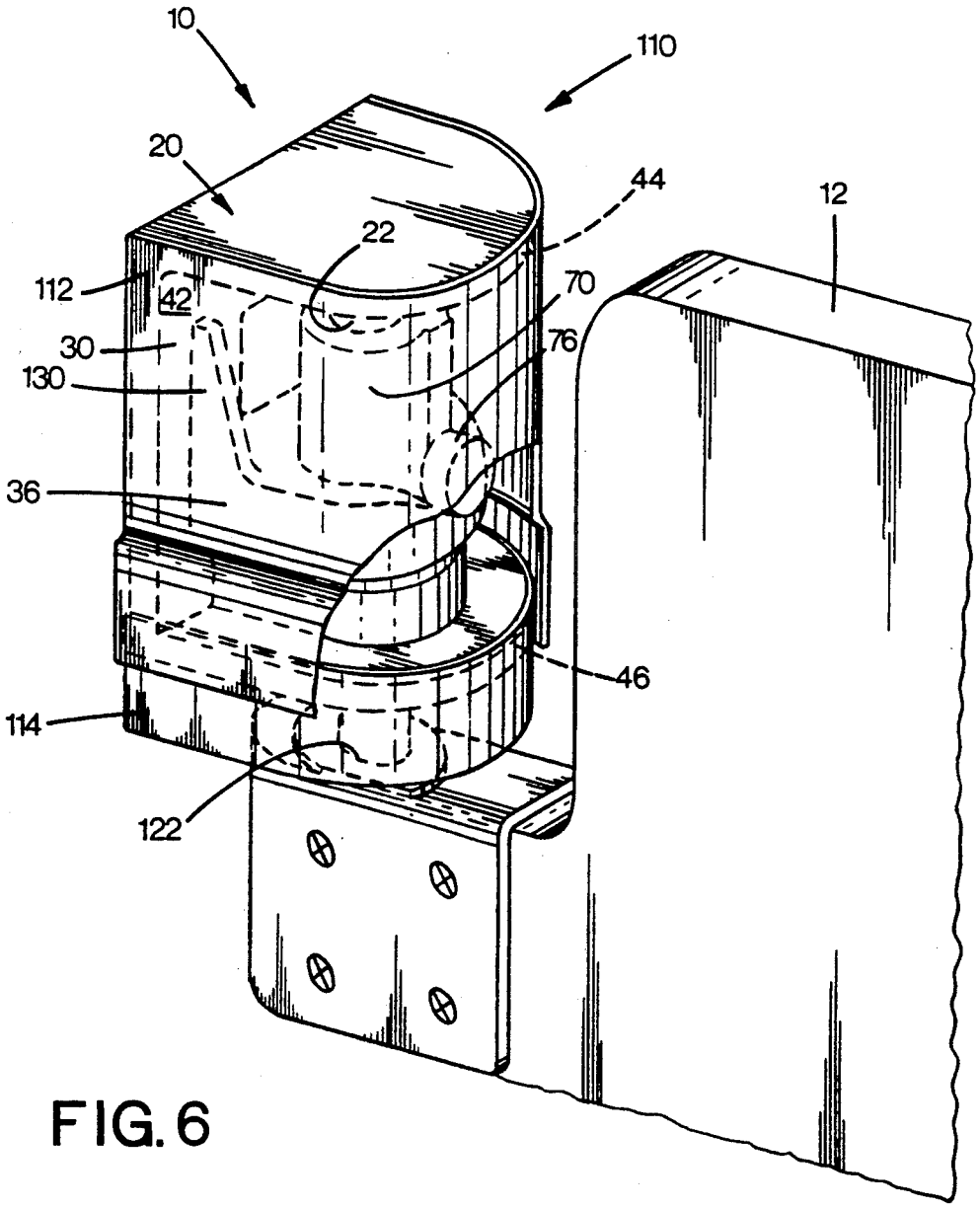
FIG. 6

GRAVITY SWING DOOR HINGE

BACKGROUND OF THE INVENTION

The present invention relates to door hinges and particularly to gravity swing door hinges.

A gravity swing door typically includes a door jamb mounting structure and a pivot post for supporting a door panel. A cam arrangement couples the jamb mounting structure and the pivot post and operates to bias the door to a closed position. The weight of the door bears against the jamb mounting structure through the cam arrangement. The force of gravity on the door brings a cam roller into a biasing depression on an inclined cam surface. When the cam roller is in the biasing depression, the door is in its closed position. Pivoting the door away from its closed position brings the cam roller out of the biasing depression and upward onto the inclined cam surface. The door is thereby raised slightly. Releasing the door allows the door to drop and pivot back to its closed position as the cam roller returns to the biasing depression.

A gravity swing door hinge is exposed to potential damage during use. The cam arrangement, pivot post and jamb mounting structure are generally exposed. These exposed inner workings of the hinge may be damaged when large heavy objects pass through the door and contact the hinge. Also, foreign objects can foul or damage the cam arrangement.

A gravity swing door presents a risk of injury to persons working near the door hinge. Because the entire weight of the door rests against the cam surface, a hazardous pinch-point for fingers and hands exists between the cam surface and the moving roller bearing. When a gravity swing door pivots, the door and the pivot post move up and down with respect to the jamb mounting structure. When the door moves upward toward the jamb mounting structure a person's hand or fingers could be trapped and injured between the top edge of the door and the jamb mounting structure.

Gravity swing doors generally have a limited range of motion. Because gravity swing doors are typically used in high traffic areas where large articles are brought through the door, it is desirable that the door swing widely open. If the door does not have a broad pivot range, movement through the door is limited. For example, if the door swings 90 degrees on each side of a plane containing the door in its closed position, a path as wide as the door jamb must be followed even after passing through the door jamb. If the door swings greater than 90 degrees, however, the path is widened immediately past the door jamb and greater mobility is achieved. Some door hinges mount at the corner of a door jamb and permit a greater range of pivot motion on one side of the door jamb. However, motion is limited on the opposite side of the door jamb. Also, the corner mount hinge does not position the door, when closed, within the opening defined by the door jamb. A hinge mounted flush to the door jamb surface does position the door within the door jamb opening. Accordingly, it is desirable that a gravity swing door hinge mount flush to the door jamb and provide greater than 90 degree pivot motion on both sides of a door jamb. Such a gravity swing door hinge would provide greater mobility for persons passing through the door while positioning the door within the door jamb opening.

SUMMARY OF THE INVENTION

In accordance with a first aspect of the present invention, a gravity swing door hinge includes a jamb mounting structure for mounting to a door jamb. Upper and lower hinge guards extend from the jamb mounting structure and define a pivot post receiving space therebetween. A pivot post connected to the door extends upward into the pivot post receiving space for pivotal support. The hinge guards protect the hinge against damage.

According to a second aspect of the present invention, a gravity swing door includes a jamb mounting structure with upper and lower flange elements extending therefrom to define a pivot post receiving space. A pivot post connected to the door extends upward through the lower flange element and into the pivot post receiving space. A cam arrangement within the pivot post receiving space couples to the pivot post and carries the weight of the door. A telescopic cover assembly encloses the cam arrangement and the lower portion of the pivot post intermediate of the door and the hinge. The only exposed moving part is an outer slip cover of the telescopic cover assembly. Exposed pinch points within the cam arrangement and between the upper edge of the door and the jamb mounting structure are eliminated.

In a third aspect of the present invention, a gravity swing door hinge flush mounts to a flat surface of a door jamb of predetermined width. A pivot post attaches to a door of predetermined thickness. The pivot post is positioned from the door jamb by a distance of at least half the thickness of the door and by a sufficient distance to enable the door to pivot through a wide range of pivot motion on each side of a plane containing the pivot axis of the pivot post.

Accordingly, it is an object of the present invention to provide a gravity swing door hinge having guards for preventing damage to the hinge.

Another object of the present invention is to provide a gravity swing door hinge without exposed pinch points within the cam arrangement and between the door and the jamb mounting structure.

A further object of the present invention is to provide a flush mount gravity swing door having a broad pivot range.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

BRIEF DESCRIPTION OF THE DRAWINGS

FIG. 1 is a perspective view of a gravity swing hinge according to the present invention;

FIG. 2 is an enlarged perspective view partially cutaway of the hinge of FIG. 1;

FIG. 3 is a side sectional view of the hinge of FIG. 1;

FIG. 4 is an enlarged sectional view of the hinge of FIG. 3 taken along lines 4—4 of FIG. 3;

FIG. 5 is a displacement view of a cam surface of the hinge of FIG. 1;

FIGS. 6 and 7 show an alternative embodiment of the present invention having a modified telescopic cover assembly.

DETAILED DESCRIPTION OF THE INVENTION

Figure 8:
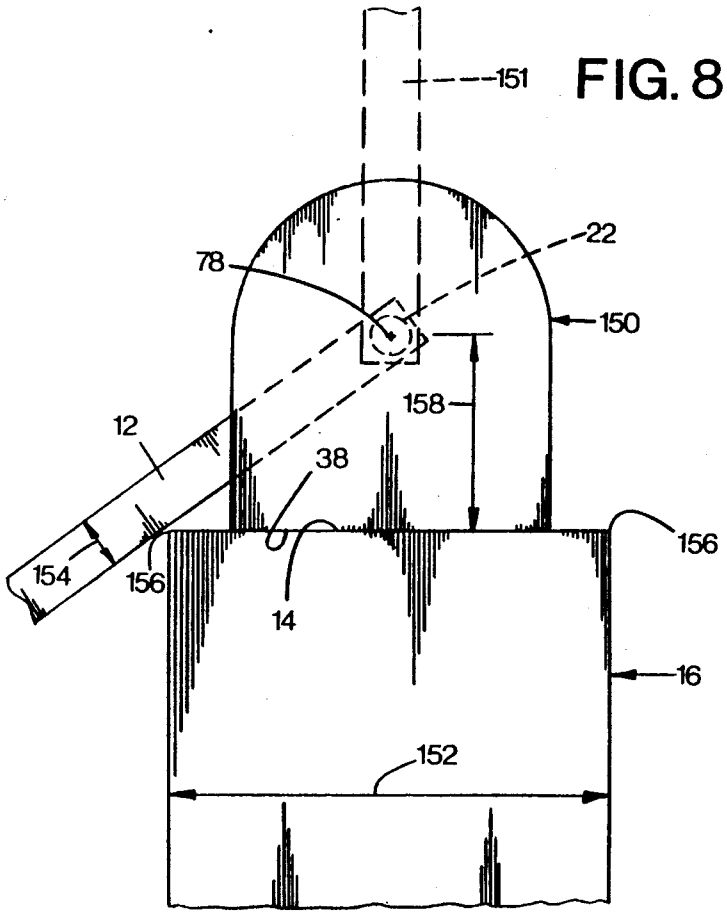
FIG. 8 is a top view of a door hinge adapted for flush mounting to a door jamb while providing a broad pivot range.

FIG. 1 illustrates a gravity swing door hinge 10 according to the present invention. The hinge 10 pivotally mounts a door 12 to a flat vertical surface 14 of a door jamb 16. FIG. 2 shows the hinge 10 partially cut away to show a cam arrangement 18 and a hinge body 20. A pivot post 22 attaches to the door 12 by way of a bracket 23. The cam arrangement 18 pivotally couples the pivot post 22 and the hinge body 20 to establish a pivotal relationship between the door 12 and the jamb 16.

Pivot post 22 and bracket 23 couple the door 12 to the hinge 10. A common mechanism which may be substituted for pivot post 22 and bracket 23 is a spine hinge. A spine hinge extends the full length of the door 12 and attaches to the door 12 by a bracket also running the full length of the door 12. The spine hinge would include a portion similar to pivot post 22 extending upward into the hinge 10. Cam arrangement 18 would then couple the spine hinge to the hinge body 20 as described above. For the purposes of the present discussion, such a spine hinge is substantially equivalent to pivot post 22 and bracket 23 in that each couples.the door 12 to the hinge 10.

A telescopic cover assembly 24 protects the inner workings of the hinge 10. An inner hinge cover 26 is stationary and attaches to the hinge body 20. An outer hinge or slip cover 28 slides vertically in relation to the inner hinge cover 26 and extends below the hinge body 20 to cover the pivot post 22. As the door 12 moves vertically in response to pivotal motion, the outer hinge cover 28 follows the motion of the door 12. As a result, the only exposed moving part is the outer hinge cover 28. The hinge covers 26 and 28 are each rigid elements formed from sheet metal stock. The hinge 10 is thereby protected from damage and potentially hazardous pinch points are shielded.

With reference to FIGS. 1–4, the hinge body 20 is a unitary cast iron body having a jamb mounting structure 30, an upper planar flange element 32, a lower planar flange element 34, and a cam body 36. The jamb mounting structure 30 is planar with a flat back surface 38 (FIGS. 3 and 4) for flush mounting in face-to-face relation to the surface 14 of the jamb 16. Mounting screws 40 extend through the structure 30 and into the door jamb 18 to secure the hinge body 20 to the door jamb 16.

The upper planar flange element 32 extends perpendicularly from the front surface 42 of the jamb mounting structure 30. The outer edge 44 of the upper planar flange element 32 is semicircular. The lower planar flange element 34 also extends perpendicularly from the front surface 42 of the jamb mounting structure 30 and has a semicircular outer edge 46. The upper and lower planar flange elements 32 and 34 are arranged in spaced parallel relation with respect to one another to define a space therebetween. The flange elements 32 and 34 are vertically aligned with the outer edge 44 of the former directly above the outer edge 46 of the latter.

The cam body 36 is attached to the front face 42 of the jamb mounting structure 30 and to the lower planar flange element 34. The cam body 36 is then intermediate of the upper planar flange element 32 and the lower planar flange element 34. The lower planar flange element 34 includes a post aperture 48 (FIG. 3). The cam body 30 includes a vertical cylindric post aperture 50 in concentric vertical alignment with the post aperture 48 of the lower flange element 34. The apertures 48 and 50 receive the pivot post 22 to maintain the post 22 in vertical orientation and provide a journal bearing for pivotally supporting the post 22.

The cam body 30 includes an upward facing contoured cam surface 56 surrounding the upper end of the post aperture 50. FIG. 5 is a displacement diagram of the cam surface 56. As may be seen, the cam surface 56 slopes downward from the portions 58 adjacent the front face 42 of the jamb mounting structure 30 to a centrally positioned roller receiving depression 60 most distant from the front surface 42.

A collar 70 attaches by clamping screws 72 to the distal end of the pivot post 22 subsequent to insertion of the pivot post 22 within the apertures 48 and 50. A bearing post 74 of the collar 70 extends radially outward with respect to the pivot post 22 when the collar 70 is attached to the pivot post 22. A roller bearing 76 mounts rotatably upon the bearing post 74 and carries a substantial portion of the weight of the door 12 against the cam surface 56. Thus, the weight of the door 12 biases the bearing 76 toward the roller biasing depression 60 and closes the door 12. When the door 12 pivots about a vertical pivot axis 78 away from the closed position, the roller bearing 76 rolls out of the depression 60 and upward across the cam surface 56 toward the front surface 42 of the hinge body 20. The door 12, the pivot post 22, the collar 70 and the roller bearing 76 then rise vertically with respect to the hinge body 20. When the door is released the influence of gravity causes it to swing to center as the roller bearing 76 rolls across the cam surface 56 and returns to the depression 60.

As discussed earlier, the rigid telescopic cover assembly 24 protects the inner workings of the hinge 10 from damage and prevents potential injury to hands and fingers. The semi-tubular inner hinge cover 26 attaches to the outer edges 44 and 46 of the upper and lower planar flange elements 32 and 34, respectively, and attaches to the outer side edges 80 of the jamb mounting structure 30. The inner hinge cover 26 cooperates with the upper and lower planar flange elements 32 and 34 to enclose the cam body 36, the collar 70, and the roller bearing 76. Two guide pins 86 extend horizontally from opposite sides of the cam body 36 and through the apertures 88 (FIG. 4) in the inner hinge cover 26. The semi-tubular slip cover 28 is positioned adjacent the inner hinge cover 26 and is vertically slidable with respect thereto. The slip cover 28 includes two vertical guide pin slots 92 for receiving the guide pins 86 and maintaining alignment of the slip cover 28 with respect to the inner hinge cover 26.

The slip cover 28 is operatively coupled to the door 12 for vertical movement therewith. The slip cover 28 includes a horizontal lower end panel 94 which rides on the upper surface 95 of the bracket 23. The panel 94 includes a post aperture 96 in concentric vertical alignment with the apertures 48 and 50 to accommodate the pivot post 22. As the door 12 pivots open and moves vertically upward, the bracket 23 raises the slip cover 28. When the door 12 pivots toward its closed position, the slip cover 28 falls under the influence of gravity along with the door 12. In following the vertical motion of the door 12, the slip cover 28 encloses the lower end of the pivot post 22 and provides an attractive overall appearance for the hinge 10. The only visible moving part is the slip cover 28.

Figure 7:
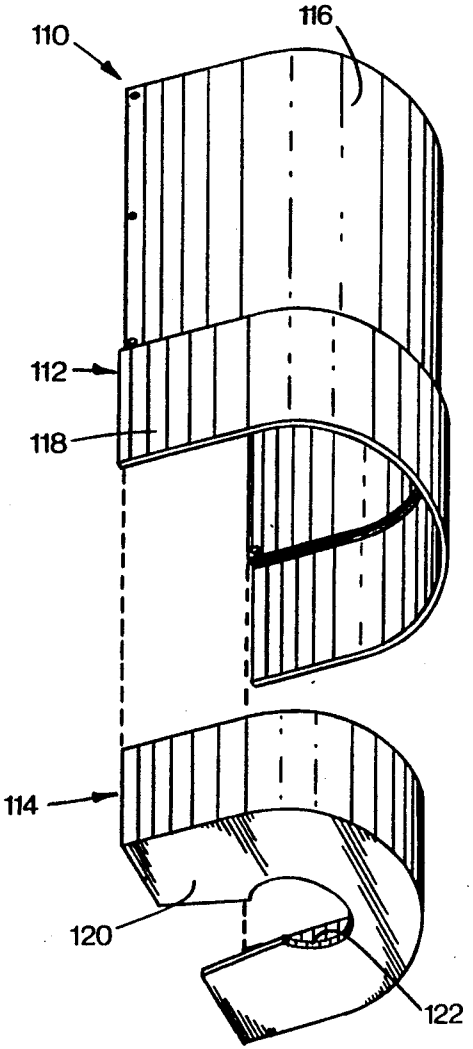

FIGS. 6 and 7 illustrate an alternate embodiment of the present invention and in which the cover assembly 24 is replaced by a cover assembly 110, but other aspects of the hinge 10 remain the same. The assembly 110 includes a stationary cover 112 attached to the hinge body 20 and a slide cover 114 which follows the vertical movement of the door 12. The stationary cover 112 is semi-tubular with a first length portion 116 having a inner radius of curvature substantially equal to the outer radius of curvature of the semi-circular upper and lower edges 44 and 46 of the hinge body 20. A second length portion 118 of the stationary cover 112 has a slightly greater radius of curvature and, as will be discussed more fully, accommodates the slide cover 114 in telescopic nesting fashion. Covers 112 and 114 are each substantially rigid elements formed from sheet metal stock. The stationary cover 112 attaches to the upper edge 44 and along the side edges 86 of the hinge body 20. A semi-annular space is then provided between the lower edge 46 and the inner surface of the portion 118 of the cover 112.

The slide cover 114 is semi-tubular and has an inner radius of curvature substantially equal to the inner radius of curvature of the portion 116 and substantially equal to the outer radius of curvature of the edges 44 and 46. The slide cover 114 has an end panel 120 with a post aperture 122. The end panel 120 rests on the surface 95 of the bracket 23 and follows the vertical movement of the door 12. The slide cover 114 slides between the edge 46 and the inner surface of the length portion 118 of the cover 112 as the door opens and closes, but the hinge mechanism remains fully enclosed.

In the embodiment of the hinge 10 shown in FIG. 6, uprights 130 extend from the cam body 36 upward and attach to the front face 42 of the jamb mounting structure 30. The uprights 130 provide structural support for the hinge body 20. Because the hinge body 20 is a cast body, the uprights 130 are formed as integral to the cam body 36 and the jamb mounting structure 30. As seen in FIG. 6, only one upright 130 is visible. However, a second similar upright 130, obscured by collar 70, should be included. As will be discussed more fully hereafter, hinge 10 may be adapted to permit the door 12 to swing widely open. The uprights 130 should be positioned a sufficient distance from the post 22 and the collar 70 to permit the roller bearing 76 to pass the upright 130 and the collar 70 as the door 12 swings widely open. Alternatively, the uprights 130 may be positioned to engage the roller bearing 76 as the door swings open; in such case, the uprights 130 serve as stops for limiting the range of motion of door 12.

FIG. 8 shows a third embodiment of the present invention adapted for a broad range of pivot motion. It has been determined that a flush mount hinge may provide a broad range of pivot motion when the thickness of the door and the width of the door jamb are taken into account. FIG. 8 shows a hinge 150 flush mounted to the surface 14 of the door jamb 16. The hinge 150 pivotally supports the door 12 with respect to the door jamb 16. In its closed position 151, the door 12 rests within a plane containing the pivot axis 78 and bisecting the door jamb 16.

The door jamb 16 is of a predetermined width 152 and the door 12 is of a predetermined thickness 154. The pivot axis 78, as defined by the pivot post 22, is positioned with respect to the back surface 38 of the hinge 150 in order to provide a broad range of pivot motion. To allow the door 12 to pivot at least 90 degrees on either side of its closed position 151, the axis 78 must be spaced from the surface 38 by at least half the thickness 154 of the door 12. To provide a pivot range greater than 90 degrees on either side of the closed position 151, the width of the door jamb 16 must be considered. The thickness 154 of the door 12 is typically one inch and the width !52 of the jamb 16 is typically between three and $\frac{5}{8}$ inches and three and $\frac{3}{4}$ inches. In the preferred form of the embodiment of FIG. 8 used in connection with the above noted typical dimensions for the door 12 and the jamb 16, the axis 78 is positioned a sufficient distance 158 from the surface 38 to permit the door 12 to pivot through 125 degrees on either side of the closed position 151 before striking one of the corner edges 156 on the door jamb 16. Variations in distance 158 will provided a similarly wide pivot range when hinge 10 mounts to a wider or a narrower jamb 16, or alternately, pivots a wider or a narrower door 12.

Thus, an improved gravity swing door has been shown. In accordance with the present invention the hinge includes flanges or guards for protecting the hinge from damage. A telescopic cover assembly protects the inner working of the hinge and substantially eliminates pinch points. Furthermore, the hinge may be flush mounted to a door jamb while providing a broad range of pivot motion on each side of its closed portion.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A door hinge for mounting to a door jamb and for supporting a door within a door opening defined by the door jamb, the door hinge comprising:

a door pivot for mounting to a door;

a body including a jamb mounting portion for mounting to the door jamb;

first and second spaced apart hinge guards projecting outwardly from the jamb mounting portion so as to define a door pivot receiving space therebetween;

means on said body for pivotally receiving the door pivot for mounting the door to the body;

means carried by said body and said door pivot and positioned between the first and second hinge guards for biasing the door to a first position relative to the door opening;

a hinge body cover mountable to said body and cooperative with said first and second hinge guards to substantially enclose said means for pivotally receiving the door pivot; and a slip cover adapted to be supported by said door slidably disposed with respect to said hinge body cover to telescope with respect thereto.

2. In combination a door and a hinge for mounting the door in pivotal relation to a door jamb of predetermined width defining a door opening, with the door comprising a door panel of predetermined thickness, and the hinge comprising a pivot post having a proximal end and a distal end, the proximal end attachable to said door panel adjacent an edge thereof;

a cast hinge body including a mounting surface adapted for mounting to said door jamb, said hinge body including means pivotally receiving said pivot post and positioning said pivot post a sufficient distance from said mounting surface for pivotal movement of said door through at least 110 degrees on each side of a plane containing the door opening;

an enclosure cover mountable to said hinge body and cooperative with said hinge body to substantially enclose said means pivotally receiving said pivot post and portions of said pivot post; and a slip cover slidably disposed with respect to said enclosure cover and adapted for vertical movement corresponding to vertical movement of said door panel.

3. A door hinge for mounting to a door jamb and for pivotally supporting a door relative to a door opening defined by the jamb, the door hinge comprising:

a pivot post having a proximal end and a distal end, the proximal end being attachable to the door;

a body having a jamb mounting portion for mounting to the door jamb and including first and second spaced apart hinge guards projecting outwardly from the jamb mounting portion to define a pivot post receiving space therebetween, said body pivotally receiving said pivot post within said pivot post receiving space;

telescoping enclosure means for substantially enclosing the pivot post receiving space; and cam means within said pivot post receiving space for coupling said pivot post and said body to bias the door by force of gravity to a closed position.

4. A hinge for pivoting a door relative to a door jamb having a door jamb face, the hinge comprising:

a hinge structure mountable on the door jamb face, said hinge structure including a first flange element, a second flange element spaced from said first flange element, and a first cam element having an upwardly facing first cam surface, said first cam element being intermediate of said first flange element and said second flange element;

means for pivotal coupling of said hinge structure and the door, said pivotal coupling means including a pivot post mountable to the door and pivotable with respect to said hinge structure, and including a second cam element mountable to said pivot post and having a second cam surface engaging said first cam surface for supporting the weight of the door thereon, one of said first cam surface and said second cam surface being contoured such that pivotal movement of the door relative to said hinge structure results in vertical movement of the door relative to said hinge structure; and a hinge cover adapted for attachment to said hinge structure, said hinge cover being detachably mounted to said first flange element and said second flange element, said hinge cover when mounted to said flange elements substantially enclosing said first cam element, said second cam element and a portion of said pivot post, and said hinge cover when removed from said flange elements exposing said first cam element, said second cam element and a portion of said pivot post, with said pivot post capable of supporting the door when said hinge cover is removed.

5. A hinge according to claim 4 wherein said hinge structure includes an aperture adjacent said first cam surface, said pivot post is rotatably disposed within said aperture, said second cam element comprises a roller bearing, and said first cam surface is contoured.

6. A hinge for pivoting a door relative to a door jamb having a door jamb face, the hinge comprising:

a hinge structure mountable on the door jamb face, said hinge structure including a first flange element, a second flange element spaced from said first flange element, and a first cam element having an upwardly facing first cam surface, said first cam element being intermediate of said first flange element and said second flange element;

means for pivotal coupling of said hinge structure and the door, said pivotal coupling means including a pivot post mountable to the door and pivotable with respect to said hinge structure, and including a second cam element mountable to said pivot post and having a second cam surface engaging said first cam surface for supporting the weight of the door thereon, one of said first cam surface and said second cam surface being contoured such that pivotal movement of the door relative to said hinge structure results in vertical movement of the door relative to said hinge structure; and a hinge cover adapted for attachment to said hinge structure, said hinge cover being cooperative with said first flange element and said second flange element to substantially enclose said first cam element, said second cam element and a portion of said pivot post, wherein said hinge cover comprises an element shaped to conform to outer edges of said first flange element and said second flange element.

7. A hinge for pivoting a door relative to a door jamb having a door jamb face, the hinge comprising:

a hinge structure mountable on the door jamb face, said hinge structure including a first flange element, a second flange element spaced from said first flange element, and a first cam element having an upwardly facing first cam surface, said first cam element being intermediate of said first flange element and said second flange element;

means for pivotal coupling of said hinge structure and the door, said pivotal coupling means including a pivot post mountable to the door and pivotable with respect to said hinge structure, and including a second cam element mountable to said pivot post and having a second cam surface engaging said first cam surface for supporting the weight of the door thereon, one of said first cam surface and said second cam surface being contoured such that pivotal movement of the door relative to said hinge structure results in vertical movement of the door relative to said hinge structure;

a hinge cover adapted for attachment to said hinge structure, said hinge cover being cooperative with said first flange element and said second flange element to substantially enclose said first cam element, said second cam element and a portion of said pivot post; and a slip cover slidably engaging said hinge cover and operatively coupled to the door for vertical movement relative to said hinge cover.

8. A hinge according to claim 7 wherein said slip cover is adapted to pass between said hinge cover and one of said first and second flange elements.

9. A hinge according to claim 8 wherein said first and second flange elements each include semi-circular outer edges with substantially equal radii of curvature, said outer edges being in substantially vertical alignment, and said hinge cover is semi-tubular with an upper portion having a radius of curvature substantially equal to the radius of curvature of said first flange element and a lower portion having a radius of curvature greater than the radius of curvature of said second flange element whereby the lower portion of said hinge cover is spaced from the outer edge of said second flange element to permit said slip cover to pass between the outer edge of said second flange element and the lower portion of said hinge cover.

10. A hinge for pivoting a door relative to a door jamb having a door jamb face, the hinge comprising:

a hinge structure mountable on the door jamb face, said hinge structure including a first flange element, a second flange element spaced from said first flange element, and a first cam element having an upwardly facing first cam surface, said first cam element being intermediate of said first flange element and said second flange element, wherein said hinge structure is a unitary cast as body;

means for pivotal coupling of said hinge structure and the door, said pivotal coupling means including a pivot post mountable to the door and pivotable with respect to said hinge structure, and including a second cam element mountable to said pivot post and having a second cam surface engaging said first cam surface for supporting the weight of the door thereon, one of said first cam surface and said second cam surface being contoured such that pivotal movement of the door relative to said hinge structure results in vertical movement of the door relative to said hinge structure; and a hinge cover adapted for attachment to said hinge structure, said hinge cover being cooperative with said first flange element and said second flange element to substantially enclose said first cam element, said second cam element and a portion of said pivot post.

11. A hinge according to claim 10 wherein said hinge structure comprises cast iron.

12. A hinge mountable on a door jamb face for pivoting a door, the hinge comprising:

a hinge structure adapted for attachment to said door jamb face;

means for pivotal coupling of said hinge structure and the door, said pivotal coupling means including means moving the door vertically with respect to said hinge structure in response to pivotal movement of the door with respect to said hinge structure; and a slide cover slidable with respect to said hinge structure and operatively coupled to the door for vertical movement relative to said hinge structure.

13. A hinge according to claim 12 wherein said hinge further comprises pin means attached to said hinge structure, said slide cover includes slot means formed therein for receiving said pin means, and a portion of said slide cover is positioned to bear against the door.

14. A gravity swing door hinge for pivotally mounting a door, having a predetermined thickness and an upper edge, to a flat vertical surface of a door jamb, the flat vertical surface having a predetermined width, the hinge comprising:

a jamb mounting structure having a front surface and a back surface, the back surface being substantially flat for mounting in face-to-face relation to the flat vertical surface of the door jamb;

an upper planar flange element extending perpendicularly from the front surface of said jamb mounting structure, the outer edge of said upper planar flange element being semicircular;

a lower planar flange element extending perpendicularly from the front surface of said jamb mounting structure, said lower planar flange element being in spaced parallel relation to said upper planar flange element to define a space therebetween, the outer edge of said lower planar flange element being semicircular and vertically aligned with the outer edge of said upper planar flange element, said lower planar flange element including a first post aperture;

a cam body attached to the front face of said jamb mounting structure and to the lower planar flange element, said cam body being intermediate of said upper planar flange element and said lower planar flange element, said cam body including a vertical cylindric second post aperture in concentric vertical alignment with the first post aperture, said cam body including a contoured cam surface surrounding an upper end of said second post aperture, said cam surface sloping downward from adjacent the front face of said jamb mounting structure to a roller biasing depression most distant from the front surface of said jamb mounting surface;

a pivot post having a proximal end attachable to the door and a distal end insertable within the first and second post apertures, said first and second post apertures forming a journal bearing for pivoting said pivot post about a vertical pivot axis;

a collar attachable to the distal end of said pivot post subsequent to insertion of said pivot post in said first and second post apertures, said collar including a bearing post extending radially outward with respect to said pivot post when said collar is attached to said pivot post;

a roller bearing rotatably mounted upon said bearing post for carrying a substantial portion of the weight of the door against said cam surface when said pivot post is attached to the door and disposed within the first and second post apertures with the collar attached to the pivot post, said roller bearing being biased to said roller biasing depression by force of gravity on the door to position the door in a closed position relative to the door jamb, said door being pivotable about said vertical pivot axis and away from the closed position whereby said roller bearing rolls across said cam surface and said door rises vertically;

a pair of guide pins extending horizontally from opposite sides of said cam body;

a semi-tubular hinge cover attached between and attached to the outer edges of said upper and lower planar flange elements and to said jamb mounting structure, said hinge cover being cooperative with said upper and lower planar flange elements to substantially enclose said cam body, collar, and roller bearing, said hinge cover including a pair of guide pin apertures through which said guide pins extend when said hinge cover is attached to said planar flange elements and said jamb mounting structure; and a semi-tubular slip cover positioned adjacent to said hinge cover and vertically slidable with respect thereto, said slip cover including a pair of guide pin slots for receiving said guide pins and maintaining alignment of said slip cover with respect to said hinge cover, said slip cover including a horizontal lower end panel having a third post aperture in concentric vertical alignment with the first and second pivot post apertures for receiving said pivot post therethrough, said lower end panel resting against the upper edge of the door whereby said slip cover is operatively coupled to said door for vertical movement therewith, said first, second and third post apertures being positioned with respect to said back surface of said jamb mounting structure to space said vertical pivot axis of said pivot post from the back surface of said jamb mounting structure by at least half the thickness of said door.

* * * * *